United States Patent [19]

Silverberg

[11] 3,966,199

[45] June 29, 1976

[54] BELT TRANSFER LOADING SYSTEM

[75] Inventor: Morton Silverberg, Rochester, N.Y.

[73] Assignee: Xerox Corporation, Stamford, Conn.

[22] Filed: Mar. 17, 1975

[21] Appl. No.: 558,750

[52] U.S. Cl. ..... 271/275; 271/193; 226/94; 355/3 R

[51] Int. Cl.[2] ..... B65H 5/02

[58] Field of Search ..... 271/18.1, 193, 275; 226/94; 317/262 A; 355/3 CH, 3 TR, 3 R

[56] References Cited

UNITED STATES PATENTS

| | | | |
|---|---|---|---|
| 3,620,617 | 11/1971 | Kelly et al. | 355/3 TR |
| 3,642,362 | 2/1972 | Mueller | 226/94 |
| 3,690,646 | 9/1972 | Kolibas | 271/193 |

*Primary Examiner*—John J. Love
*Assistant Examiner*—Robert Saifer

[57] ABSTRACT

An electrostatographic copying system in which an image is formed on an imaging surface and transferred at a transfer station to a copy sheet, where the copy sheet is electrostatically transported through the toner transfer station on a belt. As the sheet is loaded onto the belt, skewed spaced fingers hold it against the belt while a corona charge is applied through the fingers to tack the sheet to the belt.

5 Claims, 2 Drawing Figures

BELT TRANSFER LOADING SYSTEM

Figure 1:
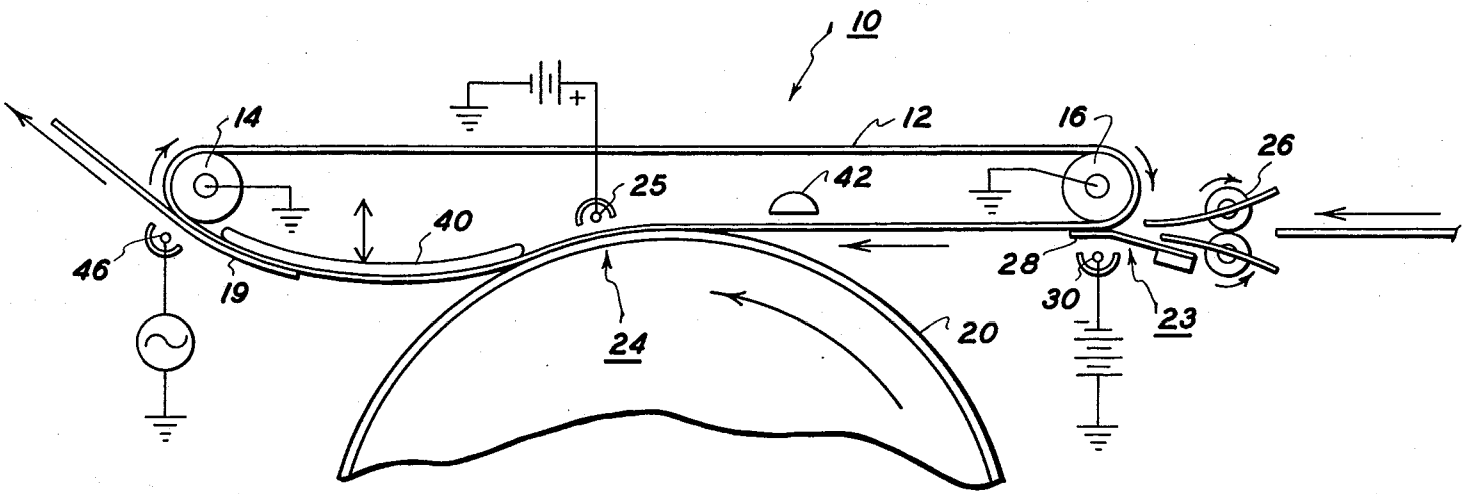

The present invention relates to electrostatographic copying systems in which the copy sheets are electrostatically tacked to and transported on a transport web.

The accurate and reliable transport of copy sheets, particularly cut paper, through the several work stations of electrostatographic copying systems is a particular problem due to the highly variable nature of such materials. Paper jams are one of the main causes of copying machine shut-downs. Various sheet transporting devices, such as mechanical grippers, vacuum and other transport belts, feed rollers, wire guides, charged photoreceptors, etc., are well known. Generally several different transport systems are utilized, and the sheets must be transferred between transport systems. Each such sheet transport transfer adds a potential jam area, especially if the sheet has a pre-set curl. Both the image transfer and fusing work stations have particular sheet handling problems because of electrical and thermal and pressure effects on the sheet.

It is generally known that a copy sheet can be transported on a belt or other member on which it is held by an electrostatic charge. The following U.S. patents are exemplary of this art: U.S. Pat. Nos. 2,576,882 to P. Koole et al.; 3,357,325 to R. H. Eichorn; 3,642,362 to D. Mueller; 3,690,646 to J. A. Kolivis; 3,717,801 to M. Silverberg; and 3,765,957 to J. Weigl. Electrostatic original document detention is disclosed in U.S. Pat. Nos. 3,194,131; 3,419,264; and 3,634,740, of which 3,419,264 discloses a moving electrostatic document belt.

In a conventional transfer station in xerography, the toner (image developer material) is transferred from the photoreceptor (the original support and imaging surface) to the copy paper (the final support surface). The toner is then fixed to the copy sheet, typically in a subsequent thermal fusing station. Transfer is most commonly achieved by electrostatic force fields created by D.C. charges applied to or adjacent the back of the copy sheet (opposite from the side contacting the toner-bearing photoreceptor sufficient to overcome the charges holding the toner to the photoreceptor and to attract most of the toner onto the sheet. These xerographic transfer fields are generally provided in one of two ways, by ion emission from a transfer corotron onto the paper, or by a D.C. biased transfer roller or belt rolling along the back of the paper.

A particular copy sheet transport problem is the accurate and positive transporting of sheets into, through, and out of a xerographic or other electrostatographic transfer station. The copy sheet must be maintained in accurate registration with the toner image to be transferred. The transfer electrostatic fields and transfer contact pressure are critical for good transferred image quality. Further, the sheet typically acquires a tacking charge and the imaging surface has a charge on it as well. An uneven or non-uniform charge on the copy sheet or its transport as the sheet passes through the transfer station can cause transfer defects observable on the final copy.

It is desirable to fully support and positively retain the copy sheet on the same transport through at least the entire transfer station, particularly including the removal of the sheet from the imaging surface. It is known to provide electrostatic tacking for continuously positively retaining a copy sheet, including its passage through a transfer station, on a moving belt surface. It is known that the sheet or belt should not unevenly charge so as to affect transfer, and the sheet must be closely urged against the belt for loading, since the electrostatic tacking forces are only effective when the sheet is intimately adjacent the belt. The charging of the paper or its transport belt for tacking them together contributes to or detracts from the total transfer field potential, and is generally undesirable unless this additional charge can be held constant.

Considering particularly references to prior transfer belt systems, U.S. Pat. No. 3,357,325, issued Dec. 12, 1967, to R. H. Eichorn et al., discloses a xerographic transfer station including an endless loop belt for electrostatically carrying the copy sheets through the transfer station, including contact with the xerographic drum, and corona charging means for placing a transfer charge on the back of the endless transfer belt at the transfer station. In this patent D. C. corona charging means charge the sheet of copy paper on the belt prior to transfer, so as to tack the paper on the belt electrostatically. This Eichorn et al. patent teaches the features of interest herein, including a document sensor and means for lifting the copy sheet transport belt away from the photoreceptor, but a different sheet loading arrangement utilizing a roller 168 [Column 6, top]. A separate transport belt to which the original document is electrostatically tacked (obviously not for transfer) includes leaf-spring-type guides as described at Column 4, second paragraph thereof.

Other very relevant references to belt copy sheet transport systems for transfer in xerograhic copiers with corona generator electrostatic sheet tacking including U.S. Pat. Nos. 3,404,418, issued Oct. 8, 1968, to J. Fantuzzo, and U.S. Pat. No. 3,697,170, issued Oct. 10, 1972, to G. C. Bhagat and J. M. Randall. All of the references cited herein teach details of various suitable exemplary xerographic and other structures, materials, systems and functions which the present invention may utilize or be associated with, and these are incorporated by reference in this specification, where appropriate.

Of lesser interest is U.S. Pat. No. 3,647,292, issued Mar. 7, 1972, to D. J. Weikel, Jr., which discloses another type of transfer belt system. This and other references are cited in U.S. Pat. No. 3,832,053, issued Aug. 27, 1974 to N. S. Goel and G. M. Fletcher, in which a transfer belt has closely spaced biased conductive strips therein for copy sheet retention.

The sheet transport system of the invention may be utilized in any desired path, orientation or configuration. It may be utilized for transfer with an imaging surface which has any desired configuration, such as a cylinder or a belt, and for either simplex or duplex (two-sided) copying.

Figure 2:
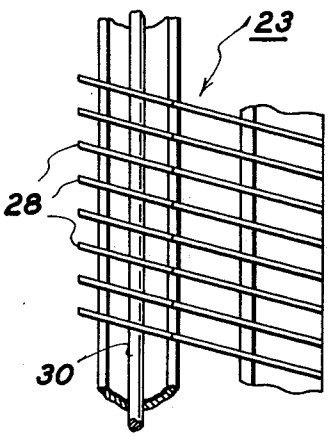

Further objects, features and advantages of the present invention pertain to the particular apparatus, steps and details whereby the above-mentioned aspects of the invention are attained. Accordingly, the invention will be better understood by reference to the following description of one example thereof, and to the drawings forming a part thereof, which are generally to scale, wherein:

FIG. 1 is a schematic side view of an exemplary belt transfer system in accordance with the present invention, in an otherwise conventional xerographic copying system; and FIG. 2 is a top view of the sheet loading guide fingers and corona generator of FIG. 1, taken along the plane of the sheet transport belt.

There is schematically shown in the embodiment of FIGS. 1 and 2, a belt transfer system 10 as one example of the present invention. Since many of the details thereof are well known and fully described in the above-cited and other references, those known details, for improved clarity, will not be described in detail herein.

The system 10 here includes an endless copy sheet transport belt 12 which is supported and rotatably driven between grounded conductive rollers 14 and 16. The transport belt 12 is preferably constructed from a relatively thin and uniform conventional dielectric material such as 2–3 mil Tedlar, or 5 to 25 mil Mylar (polyetheleneterethalate), for example. An additional backing layer may also be provided, if desired. The belt 12 has a width greater than that of the copy sheets 18 being transported on it for fully supporting them.

The copy sheet transport belt 12 positively supports, holds and carries the illustrated copy sheet 19 into and out of contact with an imaging surface 20 of a xerographic copying system here at a transfer station 24, and then on off to a conventional fuser (not shown). Transfer is provided here at the transfer station 24 by a positively biased transfer corotron 25 behind the belt 12 after (slightly downstream) of the intial contact area of the belt 12 with the imaging surface to avoid pre-nip transfer. The xerographic copying system would, of course, also include the conventional work stations for cleaning, charging, optical imaging and toner development of the photoconductive imaging surface 20 prior to the transfer station 24.

At a sheet loading station 23, a copy sheet 18 is loaded onto the belt 12, and electrostatically secured thereto for all of the subsequent travel of the sheet on the belt. The loading station 25 comprisies a sheet feeder 26, a set of sheet guide and holddown fingers 28, and a sheet tacking corona charge generator 30. FIG. 2 is a top view of these sheet holddown fingers 28 and the corona generator 30 which they overlie.

It may be seen that the sheet guide fingers 28 comprise a plurality of elongated fingers in the form of thin rods or wires or the like extending from a position substantially below the belt 12 up towards the belt, but extending primarily in the direction of the movement of the belt at the loading station 23. The fingers 28 as a unit extend fully across the belt to provide a guide for deflecting and directing against the belt any copy sheet which is being fed against the fingers in the direction of belt movement. It may also be seen from FIG. 2 that the fingers 28 extend between the otherwise conventional D. C. corona generator 30 and the belt 12. The corona generator 30 is located under the cantilevered free ends or terminal portions of the fingers 28, which are in resilient spring loaded sliding contact with the belt 12 in the absence of a copy sheet therebetween. Thus, the sheet guide fingers 28 are in the area of emission of charges from the corona generator 30, but are spaced substantially away from the corona generator 30 at approximately the same distance as the belt 12 and the copy sheet 18.

The sheet feeder 26 can be any suitable or conventional sheet feeder such as the pair of feed rollers and associated sheet guides illustrated in FIG. 1. The sheet feeder 26 functions to feed the copy sheet between the sheet guide fingers 28 and the transport belt at the loading station 23 in the same direction and speed as the belt 12 at the loading station. As the sheet 18 is driven into the loading station by the sheet feeder 26 its lead edge is deflected and guided up into direct contact with the surface of the belt 12. There the movement of the belt 12 together with the sheet feeder 26 causes the sheet to continue its motion along the belt 12 at the same speed as the belt. The sheet thus slides under the ends of the guide fingers 28, slightly deflecting the fingers away from the belt 12 only by the sheet thickness. Since the sheet guide fingers 28 are stationary they always maintain their area of pressure engagement with the sheet 18 against the belt directly over the area of emissions from the corona generator 30.

It may be seen that the sheet guide fingers 28 are substantially spaced apart to provide openings for the corona generated charges from the corona gnerator 30 to pass between the individual fingers. The thickness or lateral dimensions of the fingers 28 are only a minor portion of the spacing therebetween. These spacings are preferably uniform, although that is not critical.

Preferably the holddown fingers 28 are electrically insulated or floating with respect to electrical ground by being wholely dielectric or dielectric material coated metal. This is to avoid drawing current from the corona generator 30 or otherwise greatly distort the charge distribution therefrom.

Importantly, it may be seen that the sheet guide fingers 28 are skewed relative to the direction of motion of the copy sheet 18 and belt 12. That is, although the fingers 28 primarily extend in the same direction, although they are linear and parallel one another, they are not parallel the direction of motion of the copy sheet and belt. Rather, they extend at a slight angle thereto sufficient to cause the spaces between the fingers to substantially overlap in the direction of movement of the copy sheet over the corona generator 30.

The above-described arrangement and function allows the sheet guide fingers 28 to extend directly over the output of the corona charging device 30 and to directly press the copy sheet against the belt while it is being charged, yet not cause an uneven charge distribution on the copy sheet. With this arrangement, any blockage of the tacking charge currents from the corona generator 30 by any finger will be intermittent, as any point on the sheet surface will pass only intermittently and briefly under a skewed finger 28 and will be exposed between fingers for most of its passage past the corona generator 30. Thus, the copy sheet may be mechanically pressed into intimate contact with the transfer belt simultaneously with the copy sheet being charged, so as to insure positive electrostatic tacking of the copy sheet to the belt regardless of most paper curls, etc., yet without interferring with this charging and without causing non-uniform charged sites on the copy sheet which could interfere with uniform image transfer. Thus, print-out or other observable transfer defects in the copy image are prevented without sacrificing the reliability of the initial tacking of the copy sheet, particularly the lead edge, to the belt.

The holddown fingers 28 hold the copy sheet firmly and uniformly against the belt surface during its charging to insure achieving maximum holddown forces, including preventing buckles or large air gaps between any significant area of the copy sheet and the belt. The skewed orientation of the fingers 28 provides mechanical sweeping of a much larger area of the copy sheet with the fingers then would be the case for the same size fingers extending parallel the copy sheet movement.

It will be noted that the belt 12 at the loading station 23 overlies an electrically grounded collar 16. This provides a ground substrate for the belt opposite the corona charge generator 30, as desired. As the belt 12 separates from the roller 16 in its further movement, air ionization may take place between the roller 16 and the rear surface of the belt 12. This would leave the copy sheet/belt combination slightly positive here. In this embodiment the sheet tacking corona generator 30 is negatively biased for negative output emission to the copy sheet. This is for a negative polarity toner system. If the polarity of the toner were positive, it would be desirable to charge the copy sheet positively. With the copy sheet charged to the same polarity as the toner it will not include premature toner transfer as it enters the pretransfer pre-nip air gap of the transfer station 24.

As the belt 12 and the copy sheet electrostatically tacked thereto proceed together downstream toward the transfer station 24, there can be provided a document sensor 42 for indicating the entry of the lead edge of the document into the transfer station 24. This can be a conventional electrooptical, mechanical, acoustical, or other type of sensor. Its function is to sense a copy sheet feeding failure and to then automatically turn off the transfer corotron 25 and also to retract a movable shoe 40.

The movable belt deflector shoe 40 functions to hold the belt 12 down into engagement with the imaging surface 20 in the transfer area 24. When the shoe 40 is retracted, the normal linear undeflected path of the belt 12 holds it out of contact with the imaging surface 20. This, and shutting off the transfer corotron 25, prevents the belt 12 from being contaminated by toner when a copy sheet is not present in the transfer nip, and also protects the imaging surface. The shoe 40 may be a simple arcuate low friction belt guide or deflector as illustrated.

It will be appreciated that the document sensor 42 and the belt deflector 40 are not essential and may be eliminated. A conventional brush or other cleaning system may be provided for the belt 12 to remove transferred toner therefrom.

Transfer is accomplished in the transfer station 24 by the transfer corotron 25 in a known manner. The corotron 25 here is positively biased to apply positive charges to the rear surface of the belt 12 in the transfer station 24. It is positioned to apply these charges somewhat after the belt and the copy sheet thereon have already made contact with the imaging surface 12, so as to reduce potentials in the pre-nip air gap. The magnitude of the charge provided by the corona generator 25 in the transfer nip itself can be quite high, approaching the breakdown voltage of the belt 12. Alternatively, a biased transfer roller against the back of the belt 12 can be substituted for the corona generator 25. Such a roller may also mechanically control the belt to imaging surface contact zone and thereby replace the movable shoe 40. The sheet tacking forces applied by the loading station 25 retain the copy sheet on the belt through the transfer station 24. The positive transfer charges applied to the back of the belt by the corotron 25 can greatly increase this electrostatic attraction and retention of the negatively charged copy sheet to the belt and provide stripping of the sheet away from the imaging surface 20 by its retention on the belt. These strong positive charges can remain on the back of the belt 12 as it leaves the transfer station 24 and overwhelm the slightly repulsive action of the negative charge on the copy sheet towards the negative toner on the copy sheet. Mechanical or pneumatic stripping of the copy sheet from the imaging surface 20 is not required. Thus, the upper limit of the transfer field forces is not restricted by sheet stripping requirements.

As the belt and copy sheet continue down the belt 12 path to the position illustrated by the copy sheet 19 here, it may be seen that the belt 12 passes around the opposite end pulley 14, which provides a sharp arcuate bend in the belt 12. This provides beam strength stripping of the copy sheet 19 from the belt 12, as shown, and this is assisted by a conventional A. C. charge neutralizing corotron (detacking corona generator) 46 facing the belt 12 as it passes over the grounded roller 14 at this stripping point. The belt 12 could be continued through a fusing station prior to the copy sheet being stripped therefrom, if desired.

In conclusion there has been described herein a novel electrostatic copy sheet transport system for an electrostatographic copier which is capable of providing improvements in both copy sheet handling and transfer reliability. Numerous modifications and variations thereof will be obvious to those skilled in the art. The following claims are intended to cover all such variations and modifications as fall within the true spirit and scope of the invention.

What is claimed is:

1. In an electrostatographic copying system in which an image is transferred at a transfer station from an imaging surface to a copy sheet, and wherein said copy sheet is passed through said transfer station on a moving copy sheet transport belt to which said copy sheet is electrostatically tacked prior to said passage through said transfer station, the improvement comprising:

electrical corona charge generating means spaced adjacent to said transport belt, at a copy sheet loading position on said transport belt spaced from said imaging surface, for electrostatically tacking said copy sheet to said belt with corona generated charges, and a plurality of elonated sheet guide fingers extending towards said transport belt and extending between said corona charge generating means and said transport belt at said copy sheet loading position for urging said copy sheet into engagement with said transport belt while said copy sheet is simultaneously subjected to corona charges from said corona charge generating means, said sheet guide fingers being substantially spaced apart with openings therebetween for said corona generated charges to pass therethrough, and said sheet guide fingers extending at an angle to the direction of movement of said transfer belt at said copy sheet loading position to provide for uniform charging of said copy sheet by said corona generated charges, wherein terminal portions of said guide fingers are flexibly pressed into sliding engagement with said transport belt to resiliently press said copy sheet against said belt.

2. In an electrostatographic copying system in which an image is transferred at a transfer station from an imaging surface to a copy sheet, and wherein said copy sheet is passed through said transfer station on a moving copy sheet transport belt to which said copy sheet is electrostatically tacked prior to said passage through said transfer station, the improvement comprising:

electrical corona charge generating means spaced adjacent to said transport belt, at a copy sheet loading position on said transport belt spaced from said imaging surface, for electrostatically tacking said copy sheet to said belt with corona generated charges, and a plurality of elongated sheet guide fingers extending towards said transport belt and extending between said corona charge generating means and said transport belt at said copy sheet loading position for urging said copy sheet into engagement with said transport belt while said copy sheet is simulatneously subjected to corona charges from said corona charge generating means, said sheet guide fingers being substantially spaced apart with openings therebetween for said corona generated charges to pass therethrough, and said sheet guide fingers extending at an angle to the direction of movement of said transfer belt at said copy sheet loading position to provide for uniform charging of said copy sheet by said corona generated charges, wherein said fingers are all skewed relative to said direction of movement of said transport belt, said transport belt overlies an electrically grounded roller at said copy sheet loading position, and terminal positions of said guide fingers are flexibly pressed into sliding engagement with said transport belt to resiliently press said copy sheet against said belt at said copy sheet loading position.

3. The copying system of claim 2, wherein said fingers are substantially linear and parallel one another and are substantially uniformly spaced apart and have a lateral extent substantially less than the spacing between said fingers.

4. The copying system of claim 3, wherein said fingers are electrically insulated.

5. The copying system of claim 2, wherein said fingers are electrically insulated.

* * * * *